United States Patent [19]

Daugherty

[11] 4,203,568

[45] May 20, 1980

[54] RACK FOR HOLDING SOAP BARS

[76] Inventor: Yvonne B. Daugherty, 1000 Cortez, Coral Gables, Fla. 33134

[21] Appl. No.: 915,357

[22] Filed: Jun. 14, 1978

[51] Int. Cl.[2] ..... A47F 5/00

[52] U.S. Cl. ..... 248/309 R; 211/13

[58] Field of Search ..... 248/309 R; 206/77.1; 312/351; 15/105; 211/13

[56] References Cited

U.S. PATENT DOCUMENTS

| | | | |
|---|---|---|---|
| D. 184,219 | 1/1959 | Foster | D6/89 |
| D. 212,335 | 10/1968 | Schwartz | D6/89 |
| 846,936 | 3/1907 | Nisaimoto | 206/77.1 |
| 1,966,247 | 7/1934 | Janssen | 248/309 R |
| 2,475,500 | 7/1949 | Heliote | 248/309 R |
| 2,504,536 | 4/1950 | Kisselburg | 206/77.1 |
| 2,583,207 | 1/1952 | Buck | 248/309 |
| 2,973,601 | 3/1961 | McKnight | 206/77.1 |

FOREIGN PATENT DOCUMENTS

| | | | |
|---|---|---|---|
| 1439910 | 4/1966 | France | 206/77.1 |

*Primary Examiner*—J. Franklin Foss

*Attorney, Agent, or Firm*—Clarence A. O'Brien; Harvey B. Jacobson

[57] ABSTRACT

A rack for holding soap bars includes a framework on which are mounted in upstanding orientation a plurality of flexible elements on which a bar of soap, and the like, may be disposed for proper drainage. The framework includes a generally rectangular grid forming a plurality of intersections at which the flexible elements, which are preferably bundles of bristles, are disposed, with a plurality of legs extending from the grid in the opposite direction of extension of the flexible elements for spacing the grid from a surface supporting the rack. Preferably, the rack is disposed within a tray provided for retaining the drainage from a soap bar, and the like, and preventing such drainage from spilling onto a counter top or other surface on which the rack is disposed.

1 Claim, 3 Drawing Figures

RACK FOR HOLDING SOAP BARS

BACKGROUND OF THE INVENTION

1. Field of the Invention

This invention relates generally to retainers for bars of soap, and the like, and particularly to a rack for holding a bar of soap in such a manner as to permit drainage from the bar of soap without causing damage to the soap itself or creating a mess on a counter top, wash stand, upper edge of a bathtub, or other areas where bars of soap are normally placed when not in use.

2. Description of the Prior Art

A common problem encountered with the use of bars of soap is that after each use the wet bar must be disposed in such a manner as to permit drainage of the bar. Conventionally, wash basins, and the like, provide only a recessed portion thereon for receiving a bar of soap, which results in much waste of the soap and messing of the sinks. Alternatively, soap racks and dishes are employed which may include a plurality of ridges or projections for retaining the soap bar at spaced points, but since these ridges or projections are of rigid construction damage can result to the bar of soap, thus contributing to soap waste and messing of the rack or dish.

U.S. Pat. Nos. 539,698, issued May 21, 1895 to F. H. Milligan; 1,554,837, issued Sept. 22, 1925 to M. Bock; 2,128,118, issued Aug. 23, 1938 to S. D. Burford; disclose examples of soap holding devices employing a plurality of projections to suspend the soap, while U.S. Pat. No. 3,343,774, issued Sept. 26, 1967, to J. J. Pryor, discloses a self-draining soap rest or tray employing a corrugated construction forming a plurality of ridges for receiving the soap bar. In addition, U.S. Pat. No. 3,889,073, issued Aug. 12, 1975 to K. H. Barr, discloses a soap container provided with ridges for supporting in spaced relation from a bottom wall of the container a perforated plate provided with a plurality of rigid projections for retainingly supporting a soap bar, and the like.

U.S. Pat. Nos. 2,504,536, issued Apr. 18, 1950 to R. C. Kisselburg, and 2,842,893, issued July 15, 1958, to H. Howerton, disclose soap trays provided with pivotally mounted racks in the form of frameworks which normally support a bar of soap in a position permitting drainage, and can be pivoted as desired in order to eject the soap bar into the hands of a prospective user of the soap.

SUMMARY OF THE INVENTION

It is an object of the present invention to provide a rack assembly capable of keeping a bar or cake of soap dry without wasting the soap or messing a drain board, bathtub edge, and the like on which the soap is resting.

It is another object of the present invention to provide a rack assembly for holding bars or cakes of soap, and the like, which assembly supports the soap in such a manner as not to puncture the soap and thus contribute to the waste of the soap and messing of sink drain boards, and the like.

Still another object of the present invention is to provide a rack assembly for supporting bars or cakes of soap and the like, which is capable of enhancing the esthetics of a bathroom, kitchen, and other areas where bars of soap are commonly used and kept.

These and other objects are achieved according to the present invention by providing a rack assembly having; a tray forming a liquid retaining receptacle; and an article supporting rack disposed in the tray for supporting at spaced points an article such as a cake of soap to be drained. Preferably, the rack includes a framework on which are mounted a plurality of flexible elements in upstanding orientation to cushion the bar of soap on the rack.

The framework advantageously is in the form of a rectangular grid provided with legs extending co-directionally from the grid and arranged for supporting the grid in the tray, with the rectangular grid forming a plurality of intersections at which are located the flexible elements. The latter preferably are bristles on the grid of the framework in bunches at each of the intersections of the grids, with the framework also including legs which extend co-directionally in the opposite direction of the extension of the bristles. These removably abut a bottom wall of the tray for being supported thereby.

These together with other objects and advantages which will become subsequently apparent, reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
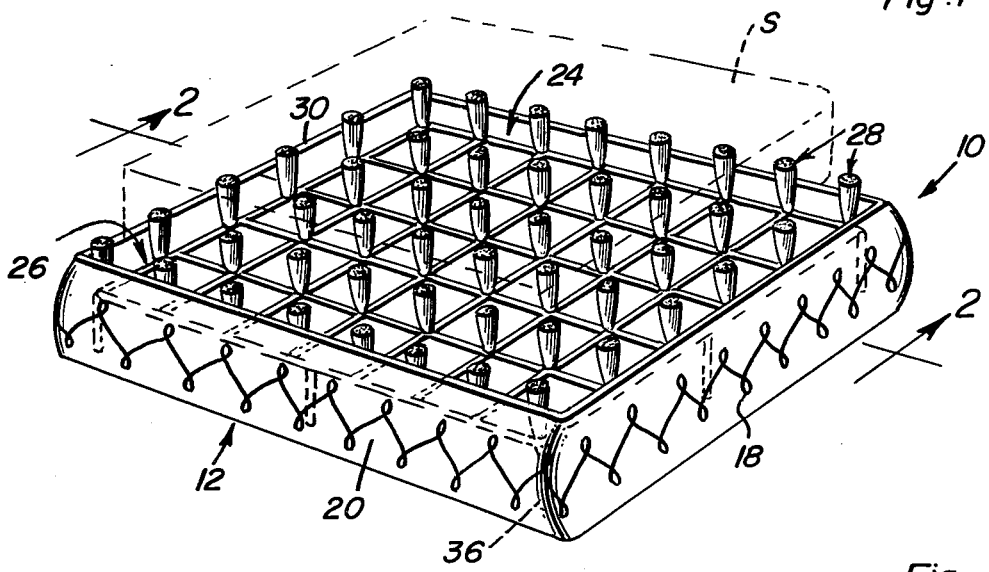
FIG. 1 is a perspective view showing a rack assembly according to the present invention.
Figure 2:
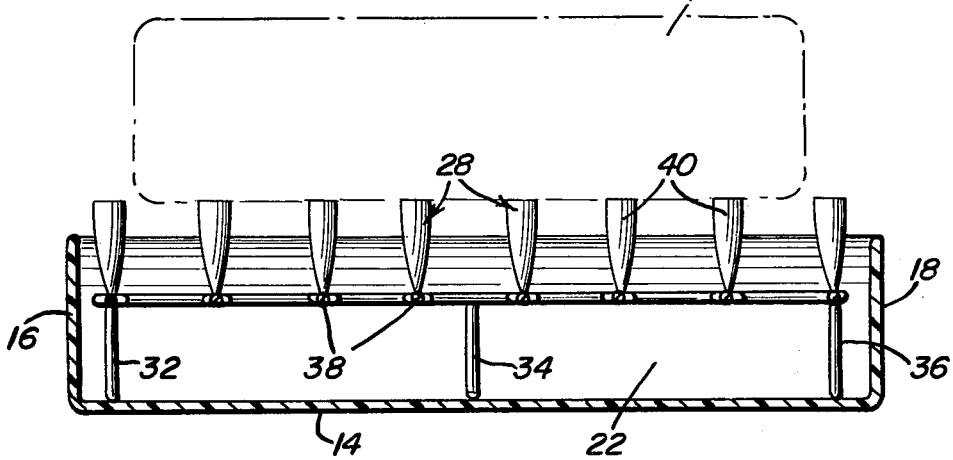
FIG. 2 is an enlarged, sectional view taken generally along the line 2—2 of FIG. 1.
Figure 3:
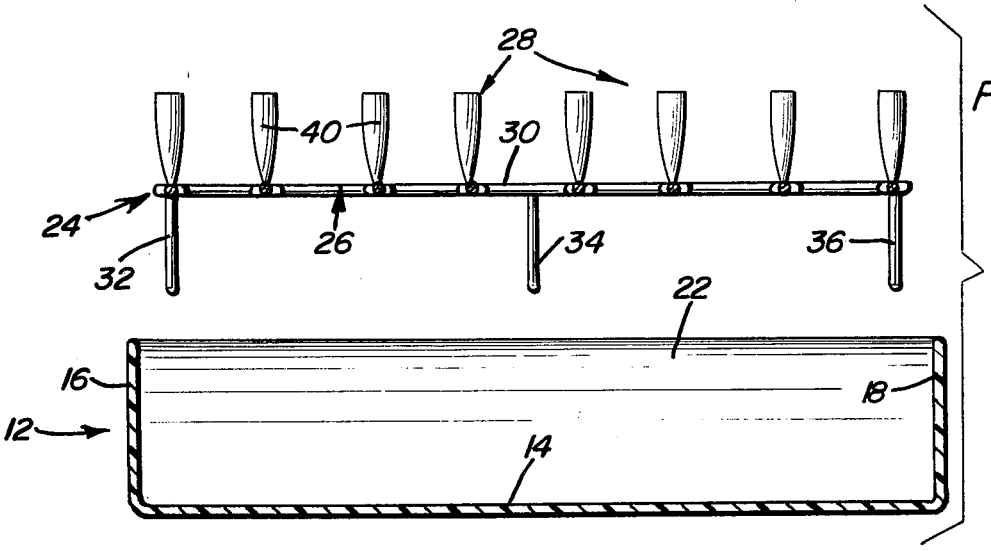
FIG. 3 is an exploded, sectional view, similar to FIG. 2, but showing in spaced relation a rack and associated tray of a rack assembly according to the present invention.

Referring now more particularly to the Figures of the drawing, the rack assembly 10 according to the present invention for holding a bar or cake of soap S includes a generally rectangular tray 12 forming a liquid retaining receptacle and comprising a substantial planar bottom wall 14 rectangular in plan and having extending co-directionally therefrom four upstanding side walls 16, 18, 20 and 22. Removably disposed within tray 12 is a rack 24 according to the invention arranged for supporting at spaced points soap S or other article to be drained.

Rack 24 includes a framework 26 and a plurality of bunches 28 of flexible elements mounted on framework 26 in upstanding orientation. More specifically, framework 26 is in the form of a generally planar grid 30 provided with legs 32, 34, and 36 extending co-directionally from the plane of grid 30 and arranged for supporting grid 30 on bottom wall 14 of tray 12.

Grid 30 is rectangular in plan and forms a plurality of intersections 38 where the wires forming grid 30 cross one another, with the flexible elements forming bunches or bundles 28 being in the form of bristles 40 constructed from nylon or other similar synthetic or natural material, with the bristles being disposed extending away from the legs, 32, 34, 36 of framework 26.

As can be readily understood from the above description and from the drawings, a rack assembly according to the present invention provides a solution to the problem of wasting soap and the messing of sinks, and the like, by keeping a cake or bar of soap dry and almost suspended in the air by the nylon bristles, and the like. The latter may be anywhere from, for example one-quarter inch to three-quarters inch high, and may be in colors to match the color employed for the associated tray. The framework of the rack itself is constructed in a conventional manner from a suitable synthetic resin, and the like, although metal may be used, with the spacing of the grid of the framework being, for example, one-half inch. The overall measurements of the rack and tray can be made to match the different standard sizes of soap available on the market. The tray can also be made from a suitable synthetic resin, although ceramic material would be suitable for fancier models, with the tray being decorated with trimmings as desired and provided in all colors to match the decor of any bathroom. Residues of soap left on the tray can be brushed away with the bristles of the rack since it is preferred that about one-quarter inch of space be provided between the rack and the walls of the tray, or such soap residue may be easily rinsed away as desired.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A rack assembly for holding soap bars, and the like, comprising, in combination:

(a) tray means forming a liquid retaining receptacle; and (b) article support means disposed in the tray means for supporting at spaced points an article to be drained, wherein the article support means includes a framework and a plurality of flexible elements mounted on the framework in upstanding orientation for supporting the article being retained, the tray means including a tray having a substantially planar bottom wall and having extending co-directionally therefrom four upstanding side walls, said framework being removably disposed within said tray, at least about one-quarter inch of space being provided between the framework and upstanding walls, whereby the tray is brushable by the flexible elements of the framework and the soap bar is allowed to dry, wherein the framework is in the form of a substantially planar wire grid provided with legs extending co-directionally from the grid and perpendicularly to the plane thereof, the legs being arranged for supporting the grid on the tray means, the wires forming the grid crossing one another with the flexible elements forming bunches or bundles in the form of bristles disposed extending away from the legs and attached to the grid where the wires forming the grid cross one another, wherein the grid is rectangular in plan and forms a plurality of intersections where the wires cross one another, the tray means being rectangular in plan and the four upstanding side walls being connected to adjacent ones of each other, the legs of the framework being disposed removably abutting the bottom wall for being supported by the bottom wall.

* * * * *